US006848134B1

(12) United States Patent
Schenck

(10) Patent No.: US 6,848,134 B1
(45) Date of Patent: Feb. 1, 2005

(54) BACKBOARD WITH REMOVABLE PAD

(76) Inventor: David Schenck, 346 Palimino Trail, Jacksonville, NC (US) 28546

( * ) Notice: Subject to any disclaimer, the term of this patent is extended or adjusted under 35 U.S.C. 154(b) by 0 days.

(21) Appl. No.: 10/686,484

(22) Filed: Oct. 15, 2003

(51) Int. Cl.[7] ..... A61G 1/04

(52) U.S. Cl. ..... 5/625; 5/626; 5/632; 5/731; 128/870

(58) Field of Search ..... 5/625–628, 632, 5/655.3, 655.5, 657, 731, 733, 734; 128/870

(56) References Cited

U.S. PATENT DOCUMENTS 2,470,398 A * 5/1949 Hayes ..... 5/710
4,655,206 A * 4/1987 Moody ..... 5/628
4,688,283 A * 8/1987 Jacobson et al. ..... 5/710
4,893,367 A * 1/1990 Heimreid et al. ..... 5/632
4,895,173 A * 1/1990 Brault et al. ..... 128/870
5,088,137 A * 2/1992 Rose ..... 5/625
5,560,059 A 10/1996 McQueen
5,785,669 A * 7/1998 Proctor et al. ..... 601/148
5,819,746 A * 10/1998 Walton ..... 128/869
6,138,306 A * 10/2000 Muhanna ..... 5/706
6,357,066 B1 * 3/2002 Pierce ..... 5/710

FOREIGN PATENT DOCUMENTS

GB 2196245 A * 4/1988 ..... A47C/27/00

* cited by examiner

*Primary Examiner*—Michael Trettel
(74) *Attorney, Agent, or Firm*—MacCord Mason PLLC

(57) ABSTRACT

Improved backboard pads for use in transporting immobilized patients on a backboard while still providing reasonable comfort to the patient include a base pad having with a plurality of gel-filled pads secured to the base pad, the gel-filled pads including first and second scapula pads positioned on either side of the longitudinal axis of the base pad, a buttocks pad between the scapula pads and the lower end of the base pad, a heel pad between the buttocks pad and the lower end of the base pad, and a headrest pad between the scapula pads and the upper end of the base pad. An inflatable lumbar pad is secured to the base pad between the scapula pads and the buttocks pad; and an inflatable knee pad is slidably positioned between the buttocks pad and the heel pad. The gel-filled pads are preferable secured in openings through the base pad.

20 Claims, 3 Drawing Sheets

BACKBOARD WITH REMOVABLE PAD

BACKGROUND OF THE INVENTION (1) Field of the Invention

The present invention relates generally to a removable pad for placement on a backboard, and in particular to a removable backboard pad that provides comfortable support to patients of different physical dimensions while holding the patient in an immobilized position.

(2) Description of the Prior Art

Backboards, also known as spine boards, are used to transport injured patients, especially patients who may have suffered a spinal injury. To be effective, the backboard must hold the patient in an immobilized position to prevent further injury. A backboard is comprised of a rigid board having a generally planar upper surface dimensioned to extend beyond an average adult's height and width, with handholds spaced along each side, and optionally the top and bottom, of the board. The backboard may be constructed of metal, wood or a rigid plastic. Restraining straps across are used to secure the patient to the board in a face-up position.

Patients must often remain in a substantially immobilized, uncomfortable position on a backboard for hours until diagnosis and treatment is possible. During this time, areas of the patient's body may become sore and irritated, and soft tissue injury may result.

Removable pads are often placed on the top surface of the backboard to reduce patient discomfort and potential injury. Most pads suggested by the prior art are comprised of a foam core that is enclosed in a waterproof, easily cleaned cover. The prior art also describes inflatable pads, similar to air mattresses. The pad is shaped to fit onto the upper surface of an adult-sized backboard with the edges of the pad being spaced inwardly from the edges of the backboard to provide access to the handholds.

Prior art backboard pads, while relieving the patient's discomfort to some extent, do so at the sacrifice of the need to maintain the patient in an immobile condition. Further, the "one size fits all" construction of prior art pads can actually increase patient discomfort. Thus, there is a continuing need for a backboard pad that will provide acceptable patient immobility while reducing the patient's discomfort. There is a further need for a backboard pad meeting these objectives with patients of different physical dimensions. Additionally, there is a need for a combination backboard and backboard pad meeting these requirements.

SUMMARY OF THE INVENTION

The backboard pad of the present invention is comprised of a combination of gel-filled sections and inflatable sections carried on a base pad. It has been found that the combination of gel-filled sections and inflatable sections provide a significant reduction in patient discomfort, while still providing the necessary immobilization.

Gel-filled sections, also referred to herein as gel-filled pads or gel pads, used in the present invention are comprised of a bladder or envelope filled with a gel, such as a urethane gel, a silicone gel, or a thermoplastic elastomer. Gel-filled pads are well known in the prior art for such uses as wrist rests, cushions, operating table pads, and bicycle seats. Different formulations and constructions of gel-filled pads will be apparent to one skilled in the art. The formulations used in the gel-filled pads are of a viscous, deformable consistency and will normally have a durometer hardness on the Shore OO scale of from about 20 to about 75, inclusive. Representative gels are sold under the trademark Isogel by Pittsburgh Plastics Manufacturing, Inc., Butler, Pa.

The gel-filled pads used in the preferred embodiment of the invention included two scapula pads, a buttocks pad, a heel pad, and a headrest pad. The scapula pads are positioned for placement beneath the patient's scapula, with a longitudinal space being left between the scapula pads beneath the patient's spinal area. Due to the mobile but incompressible nature of the gel within the gel-filled sections, the pressure of the patient's projecting scapula shifts the gel around the scapula, creating a firm support and distributing pressure around the scapula and adjacent back area, instead of placing all of the pressure on the scapula tips. The longitudinal spacing or trough between the scapula pads relieves pressure on the spinal column, while the spinal column is still immobilized due to the scapula pads on either side of the spinal column space.

The buttocks pad is spaced below the lower edges of the scapula pads and extends generally across the width of the backboard pad. The body length of most adults is basically the same, although their leg lengths may vary significantly. Slight variations are addressed by the longitudinal length of the pad. Therefore, placement of the buttocks pad in a fixed position beneath the scapula pads permits placement of the buttocks and scapula of a wide range of patients on the fixed buttocks pad and scapula pads, respectively.

The heel pad is fixedly positioned at the lower end of the backboard pad, and is generally of a width sufficient to extend across a substantial part of the backboard pad. The longitudinal length of the heel pad is sufficient to compensate for differences in the heights of patients.

The headrest pad is positioned at the upper end of the backboard pad above the upper edges of the scapula pads, and is centered above the spinal trough. Preferably, the headrest pad is a gel-filled U-shaped pad with a given thickness and an inner section having a thickness less than the given thickness of the outer section. The center section is preferably gel-filled. When used, the U supports the sides of the head and prevents head movement, while the back of the head extends into the center section without significant pressure being exerted against the back of the head.

Inflatable sections are comprised of an inflatable bag or envelope with a waterproof, easily cleaned outer surface. The bag may be constructed, for example, of a rubber, polyethylene, polypropylene, polyvinyl chloride, or other polymeric or elastomeric material that is capable of repeated flexing and is durable in outdoor conditions. The bag includes a valve stem through which the bag may be filled with a desired amount of air from an air-supply source, such as an electric or manual air pump or a compressed air source.

The preferred embodiment of the invention includes an inflatable lumbar pad and an inflatable knee pad. The inflatable lumbar pad is positioned between the lower edges of the scapula pads and the upper edge of the buttock pad and is positioned to lie beneath the patient's lumbar region. The upper surface of the lumbar pad is higher than the upper surface of the scapula and buttock pads when in the fully inflated state, and preferably lower than the upper surface of the scapula and buttock pads when the lumbar pad is in the uninflated state. As a result, comfort can be provided to patients having different lumbar curvatures by simply inflating the lumbar pad until firm contact with the patient's lumbar region results. Generally, the lumbar pad will be inflated until the pressure exerted against the lumbar region is approximately the same as the pressure against the buttocks and scapula.

The inflatable knee pad is positionable beneath a patient's knees and is used to prevent discomfort and possible injury due to lack of knee support. The upper surface of the knee pad is higher than the upper surface of the heel and buttock pads when in the fully inflated state, and preferably lower than the upper surface of the heel and buttock pads when the knee pad is in the uninflated state. Due to differences in the lengths of patients' legs, the knee pad is preferably moveable along the longitudinal axis of the backboard pad between the lower edge of the buttocks pad and the upper edge of the heel pad.

The base pad forming a part of the backboard pad is adapted to maintain the gel-filled pads and inflatable pads in the desired position, and is comprised of generally parallel upper and lower surfaces. Surfaces of the base pad should be waterproof and easily cleaned. The base pad should also be flexible for ease of storage and placement on the backboard. Preferably, the base pad is formed of a gel such as the gels used in the gel-filled pads, but of the greater hardness, e.g., from about 40 to 75 on the O Scale, so that the base pad is a flexible solid. The gel also results in a base pad with a slip-resistant bottom surface, which helps to maintain the pad in position on the backboard.

The base pad preferably includes openings to receive one or more of the gel-filled pads, with the gel-filled pads fitting within the openings. The gel-filled pads can be held in place by securing the edges of the gel-filled pads to the inner edges of the base pad openings, e.g., by radio frequency welding. With this configuration, the overall thickness of the backboard pad is reduced, promoting storage, without sacrificing the support and comfort provided by the gel-filled pads.

The base pad may also include an opening for receiving the knee pad. One or more guide belts or stringers may be longitudinally mounted within the knee pad opening, with the knee pad being slidable on the guide belts along the longitudinal axis of the backboard pad between the upper and lower edges of the knee pad opening. The lumbar pad will normally be secured, e.g., by radio frequency welding, to the upper surface of the base pad between the buttocks pad and the scapula pads. Valve stems may extend outwardly from the inflatable pads above the upper surface of the base pad, or may be extended from the inflatable pads between the base pad upper and lower surfaces to the edge of the backboard pad.

When used, the backboard pad, which may be rolled or folded for storage, is placed on top of a backboard, with the slip-resistant lower surface of the backboard pad preventing the backboard pad from sliding on the upper surface of the backboard. If desired, the gel-filled pad may be heated prior to use, with the heat retentive properties of the gel being used to provide extended heat relief to the patient. The patient is then placed on the upper surface of the backboard pad, with the patient's head being centered on the head pad, the scapula on the scapula pads, the buttocks on the buttocks pad, and the heels on the heel pad. The restraint straps are then tightened around the patient. The lumbar and knee pads are then inflated until pressure is exerted against the lumbar region and the underside of the knees, respectively. The patient may then be safely moved without danger of significant movement on the backboard, and with reasonable comfort, even for extended periods.

DETAILED DESCRIPTION OF THE INVENTION

Figure 1:
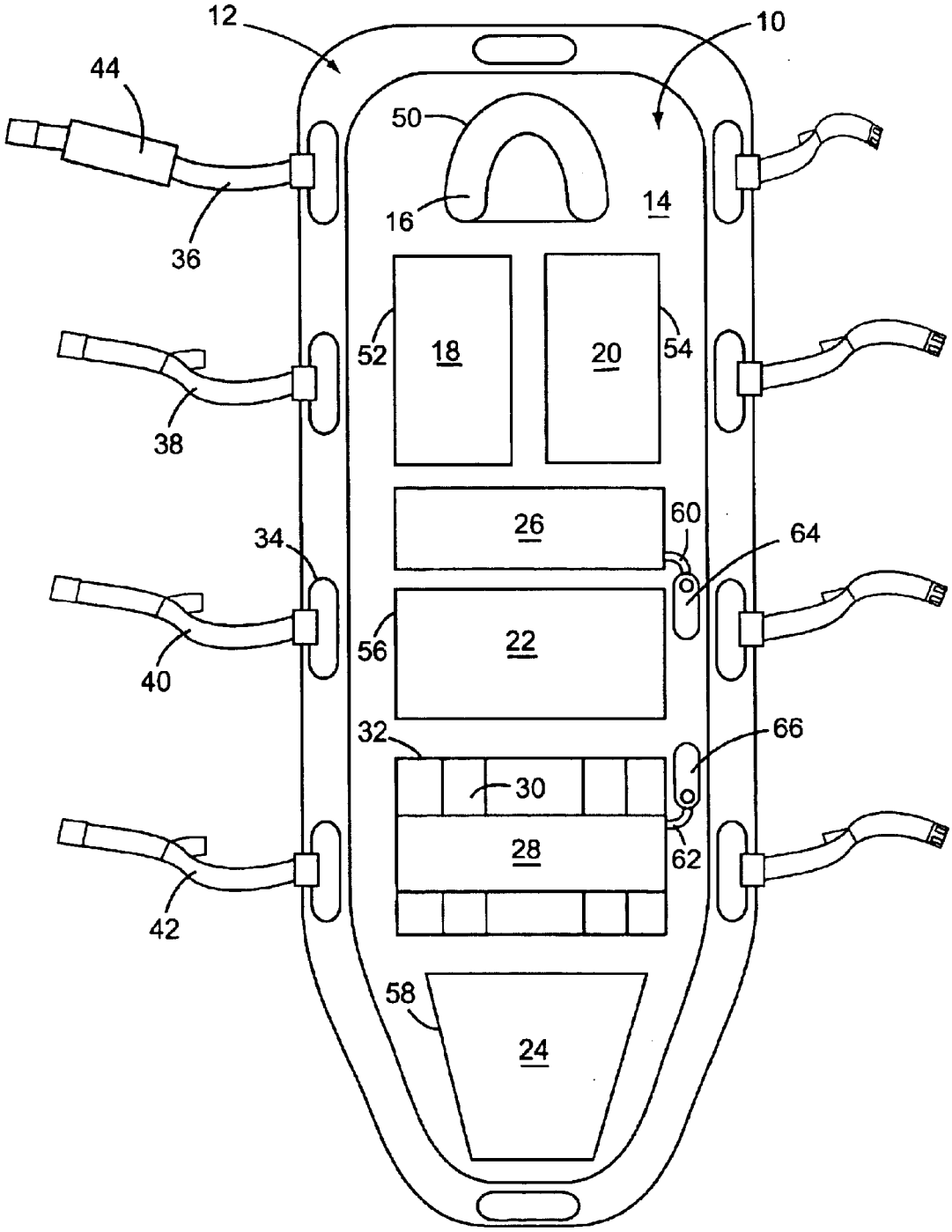
FIG. 1 is a top view of the backboard pad positioned on top of a backboard.
Figure 2:
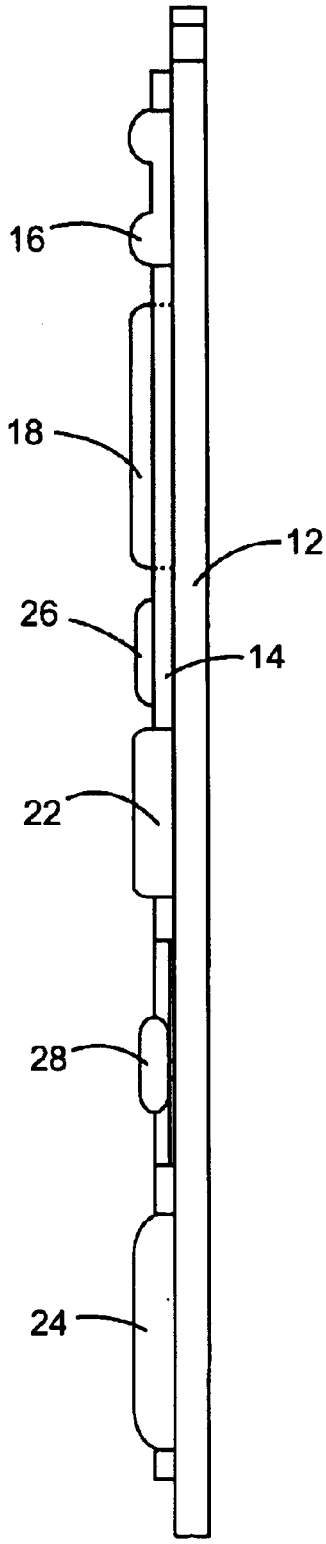
FIG. 2 is a sectional side view of the backboard pad.
Figure 3:
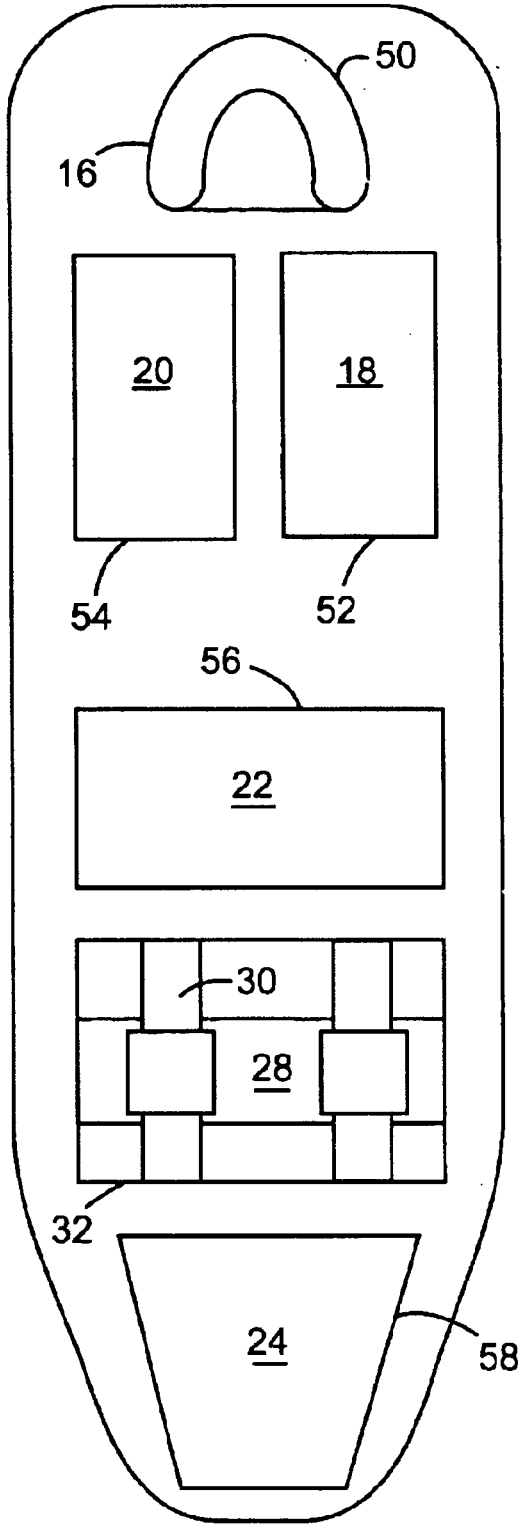
FIG. 3 is a bottom view of the backboard pad.

As illustrated, backboard pad, generally 10, adapted to be positioned on a backboard, generally 12, is comprised of a base pad 14 having upper and lower ends, opposed sides, a top surface and a bottom surface, pad 14 carrying a plurality of gel-filled sections and inflatable sections. As identified in the drawings, the gel-filled sections include headrest pad 16, scapula pads 18 and 20, buttocks pad 22, and heel pad 24. The inflatable sections are lumbar pad 26 and knee pad 28, the latter pad being slidably mounted on guide belts 30 within base pad opening 32.

Backboard 12 includes opposed sides spaced outwardly from the top, bottom and sides of pad 10, a top surface and a bottom surface, and spaced handholds 34 extending through backboard 12 between its top and bottom surfaces. A plurality of restraint belts 36, 38, 40 and 42 are attachable over pad 10 to secure a patient onto pad 10. Belt 36, used to secure a patient's head in an immobilized position on head pad 16, includes a gel-filled head strap pad 44 positionable on the patient's forehead.

One or more of headrest pad 16, scapula pads 18 and 20, buttocks pad 22, and heel pad 24, are preferably secured within openings 50, 52, 54, 56 and 58, respectively, which extend through pad 10. The pads may be secured by various means, such as radio frequency welding. Each of pads 16, 18, 20 and 22 have upper surfaces projecting above the upper surface of base pad 10, and are in the preferred embodiment about 0.75 inch in thickness. Head rest pad 16 is of U-shape shape with the thickness of the outer area being about 2 cm higher than the upper surfaces of the other gel-filled pads and the thickness of the center area being about 0.50 inch.

Lumbar pad 26 and knee pad 28 are formed of an inflatable bladder of a resilient material, such as plastic or rubber, and include attached valve stems 60 and 62, respectively, attached to a source of compressed air, shown in the preferred embodiment as manual air pumps 64 and 66, secured to base pad 12.

When used, pad 10, after being unfolded or unrolled if needed, is placed on the top surface of backboard 12 with the edges of pad 10 being spaced inwardly from the edges of backboard 12, so that handholds 34 are exposed. The patient is then placed onto the top surface of pad 10, so that the patient's head is on headrest pad 16, scapula pads 18 and 20 are under the patient's scapula, buttocks pad 22 is under the patient's buttocks, and heel pad 24 is under the patient's heels. Restraint belts 36, 38, 40 and 42 are then secured to immobilize the patient. Lumbar pad 26 is then inflated until it presses against the patient's back and knee pad 28 is inflated until it presses against the back of the patient's knees. At this point, the patient is safely immobilized for transport, while the different gel-filled and inflatable pads provide reasonable comfort to the patient, even if the patient is restrained for an extended period.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A backboard pad comprising:

a) a plurality of gel-filled pads, including first and second scapula pads, a buttocks pad, a heel pad and a headrest pad;

b) an inflatable lumbar pad;

c) an inflatable knee pad; and d) a base pad supporting said gel-filled pads and said inflatable pads, said base pad being positionable on a backboard for placement beneath a patient.

2. The backboard pad of claim 1, wherein said scapula pads are spaced on either side of a longitudinally aligned spinal trough.

3. The backboard pad of claim 1, wherein said gel-filled pads are comprised of bladders filled with a gel selected from the group consisting of urethane gels, silicone gels, and thermoplastic elastomers.

4. The backboard pad of claim 1, wherein said inflatable pads are comprised of a bladder having a valve stem connectable with a source of compressed air.

5. The backboard pad of claim 1, wherein said base pad is formed of a gel.

6. The backboard pad of claim 1, wherein said base pad includes gel pad openings, said scapula pads, buttocks pad and heel pad being within said openings.

7. The backboard pad of claim 1, wherein said knee pad is longitudinally adjustable.

8. A backboard pad for use in transporting immobilized patients on a backboard having side edges with handholds along said side edges and a top surface, said backboard pad being comprised of:

a) a base pad having an upper end, a lower end, a longitudinal axis, and opposed side edges positionable inwardly from said backboard side edges to expose said handholds, a bottom surface positionable on the top surface of said backboard, and a top surface substantially parallel to said bottom surface;

b) a plurality of gel-filled pads secured to said base pad, said gel-filled pads including first and second scapula pads positioned on either side of the longitudinal axis of said base pad, a buttocks pad between said scapula pads and the lower end of said base pad, a heel pad between said buttocks pad and the lower end of said base pad, and a head pad between said scapula pads and the upper end of said base pad;

c) an inflatable lumbar pad secured to said base pad between said scapula pads and said buttocks pad; and d) an inflatable knee pad slidably mounted on said base pad for longitudinal movement between said buttocks pad and said heel pad.

9. The backboard pad of claim 8, wherein said gel-filled pads are comprised of bladders filled with a gel selected from the group consisting of urethane gels, silicone gels, and thermoplastic elastomers.

10. The backboard pad of claim 8, wherein each of said inflatable pads are comprised of a bladder having a valve stem connectable with a source of compressed air.

11. The backboard pad of claim 8, wherein said base pad is formed of a gel.

12. The backboard pad of claim 8, wherein said base pad includes gel pad openings, said scapula pads, buttocks pad and heel pad being within said openings.

13. A patient carrier for use in transporting immobilized patients comprising:

a) a backboard having side edges with handholds along said side edges and a top surface;

b) a base pad having an upper end, a lower end, a longitudinal axis, and opposed side edges positionable inwardly from said backboard side edges to expose said handholds, a bottom surface positionable on the top surface of said backboard, and a top surface substantially parallel to said bottom surface;

c) a plurality of gel-filled pads secured to said base pad, said gel-filled pads including first and second scapula pads positioned on either side of the longitudinal axis of said base pad, a buttocks pad between said scapula pads and the lower end of said base pad, a heel pad between said buttocks pad and the lower end of said base pad, and a headrest pad between said scapula pads and the upper end of said base pad;

d) an inflatable lumbar pad secured to said base pad between said scapula pads and said buttocks pad; and e) an inflatable knee pad mounted on said base pad between said buttocks pad and said heel pad.

14. The carrier of claim 13, wherein said knee pad is slidably mounted on said base pad for longitudinal movement between said buttocks pad and said heel pad.

15. The carrier of claim 13, wherein said gel-filled pads are comprised of bladders filled with a gel selected from the group consisting of urethane gels, silicone gels, and thermoplastic elastomers.

16. The carrier of claim 13, further including restraining straps for securing a patient onto the top surface of said backboard pad.

17. The carrier of claim 13, wherein each of said inflatable pads are comprised of a bladder having a valve stem connectable with a source of compressed air.

18. The carrier of claim 13, wherein said base pad is formed of a gel.

19. The carrier of claim 13, wherein said base pad includes gel pad openings, said scapula pads, buttocks pad and heel pad being secured to said base pad within said openings.

20. The carrier of claim 13, further including a head restraint strap with a gel-filled cushioning pad positionable on the front of the patient's head.

* * * * *